US009048083B2

(12) United States Patent
Voronov

(10) Patent No.: US 9,048,083 B2
(45) Date of Patent: Jun. 2, 2015

(54) METHOD FOR OPERATING AN AMALGAM LAMP

(75) Inventor: Alex Voronov, Hanau (DE)

(73) Assignee: Heraeus Noblelight GmbH, Hanau (DE)

( * ) Notice: Subject to any disclaimer, the term of this patent is extended or adjusted under 35 U.S.C. 154(b) by 258 days.

(21) Appl. No.: 13/635,156

(22) PCT Filed: Mar. 14, 2011

(86) PCT No.: PCT/EP2011/001262
§ 371 (c)(1),
(2), (4) Date: Sep. 14, 2012

(87) PCT Pub. No.: WO2011/124310
PCT Pub. Date: Oct. 13, 2011

(65) Prior Publication Data

US 2013/0020942 A1 Jan. 24, 2013

(30) Foreign Application Priority Data

Apr. 6, 2010 (DE) ..... 10 2010 014 040

(51) Int. Cl.
*H01J 7/24* (2006.01)
*H01J 61/28* (2006.01)
(Continued)

(52) U.S. Cl.
CPC ..... *H01J 61/28* (2013.01); *H01J 61/523* (2013.01); *H01J 61/72* (2013.01)

(58) Field of Classification Search
USPC ..... 315/291, 297, 300, 307, 326, 108, 94, 315/117, 47, 114, 115, 116
See application file for complete search history.

(56) References Cited

U.S. PATENT DOCUMENTS 3,851,207 A 11/1974 McVey
4,442,379 A 4/1984 Frey et al.
(Continued)

FOREIGN PATENT DOCUMENTS

DE 102008032608 A1 1/2010
WO 2007091187 A1 8/2007
WO 2010112112 A1 10/2010

OTHER PUBLICATIONS

Int'l Search Report issued May 19, 2011 in Int'l Application No. PCT/EP2011/001262.
(Continued)

*Primary Examiner* — Douglas W Owens
*Assistant Examiner* — Jianzi Chen
(74) *Attorney, Agent, or Firm* — Panitch Schwarze Belisario & Nadel LLP

(57) ABSTRACT

In a known method for operating an amalgam lamp having a nominal power $P_{optimum}$, it is provided that a lamp voltage $U_{optimum}$ designed for a maximum UVC emission is applied between electrodes or a lamp current $I_{optimum}$ designed for a maximum UVC emission flows between electrodes. The discharge space is accessible for an amalgam deposit, which is heatable by a heating element in which a heating current $I_{heating}$ is conducted through the heating element. Starting from this background, in order to provide an operating mode that ensures a stable operation in the region of the optimum power, it is proposed that a target value of the lamp current $I_{target}$ is set that is less than $I_{optimum}$ and that the heating current $I_{heating}$ is turned on or increased when the lamp current falls below a lower limit $I_1$ and is turned off or reduced when it exceeds an upper limit $I_2$ for the lamp current.

16 Claims, 3 Drawing Sheets

(51) Int. Cl.
*H01J 61/52* (2006.01)
*H01J 61/72* (2006.01)

(56) References Cited

U.S. PATENT DOCUMENTS 4,524,306 A 6/1985 Fujimura et al.
5,095,336 A 3/1992 Corona et al.
5,120,251 A * 6/1992 Michael et al. ..... 445/9
5,274,305 A 12/1993 Bouchard
5,581,157 A 12/1996 Vrionis
2004/0232846 A1 11/2004 Fischer et al.
2009/0090667 A1 4/2009 Fraser et al.
2011/0181187 A1 7/2011 Voronov et al.
2012/0019169 A1 1/2012 Voronov et al.

OTHER PUBLICATIONS

Office Action issued Dec. 15, 2010 in DE Application No. 10 2010 014 040.6.

* cited by examiner

METHOD FOR OPERATING AN AMALGAM LAMP

CROSS-REFERENCE TO RELATED APPLICATIONS

This application is a Section 371 of International Application No. PCT/EP2011/001262, filed Mar. 14, 2011, which was published in the German language on Oct. 13, 2011, under International Publication No. WO 2011/124310 A1 and the disclosure of which is incorporated herein by reference.

BACKGROUND OF THE INVENTION

The invention relates to a method for operating an amalgam lamp having a nominal power $P_{nominal}$, comprising a discharge space containing a filling gas or in which a lamp voltage $U_{optimum}$ designed for a maximum UVC emission is applied between electrodes or a lamp current $I_{optimum}$ designed for a maximum UVC emission flows between electrodes, wherein the discharge space is accessible for an amalgam deposit, which can be heated by a heating element, in which a heating current $I_{heating}$ is conducted through the heating element.

For amalgam lamps, mercury in the form of a solid amalgam alloy is introduced into the discharge space. The bonding of the mercury in the amalgam acts against a release in the discharge space. This allows higher operating currents (and higher temperatures), so that in comparison with conventional low-pressure mercury vapor lamps, three to six times higher radiated powers and power densities can be achieved.

An operating mode of an amalgam lamp according to the generic type mentioned above is described in International patent application publication No. WO 2007/091187 A1. The amalgam lamp comprises a quartz glass tube, which is closed on both ends by crimped sections, through each of which a current feedthrough is installed into the discharge space to a coil-shaped electrode. One of the crimped sections is provided with a hollow space that is open to the discharge space and in which the amalgam is introduced. The solid amalgam is thus arranged outside of the discharge. It can be heated separately. For this purpose, a heating device is provided in the vicinity of the amalgam deposit, which heating device has its own current circuit and a temperature control. Preferably, the coil-shaped electrode is simultaneously the heating device for heating the amalgam.

Amalgam lamps are typically operated with power regulation, sometimes also current regulation, wherein the nominal power or the nominal current is designed for the optimal mercury concentration in the discharge space and the corresponding maximum UVC intensity.

In the operating mode with "constant current" the temperature of the coil-shaped electrode is kept constant, so that the amalgam deposit remains at an approximately constant temperature and, in this respect, a mercury vapor pressure that is optimum for the operation is specified. This applies, however, only as long as the outside conditions do not change. If outside temperature changes or through warming of the lamp—for example by placement in a tight space—there is however a slight increase in temperature in the area of the amalgam deposit, so that the amalgam lamp is no longer operating at its optimum operating point, this leads to a reduced power and light output.

Amalgam lamps are as a rule operated in the "constant power" operating mode by a power-regulated ballast. In this connection it is to be noted that, in conventional amalgam lamps, a maximum UVC power is produced at a mercury vapor pressure around 0.8 Pa. The optimum is shown schematically in FIG. 3, where the UVC emission (output) is plotted in relative units versus the mercury vapor pressure in [Pa].

It has now been shown that the lamp voltage changes with the mercury vapor pressure. This applies, above all, for amalgam lamps having a filling gas containing helium or neon. This dependency is shown schematically in the diagram of FIG. 4, in which on the left ordinate the lamp voltage U and on the right ordinate the lamp current I are recorded, each in relative units versus the mercury partial pressure $p_{Hg}$ in [Pa]. The optimum operating current $I_{optimum}$ produces a mercury vapor pressure around 0.8 Pa. In the operating mode with constant power P, the lamp current I has a reciprocal relationship relative to the lamp voltage U (according to $P=U\times I$). Therefore, in the power-regulated operation, each change of the lamp voltage (curve 2) is compensated by an opposite adjustment of the lamp current (curve 1). The lamp current, however, directly influences the temperature of the coil-shaped electrode and thus, accordingly, the temperature of the amalgam deposit and consequently, by the mercury vapor pressure, also the lamp voltage.

For example, if the lamp voltage falls, this is compensated by the ballast by increasing the current, which, in turn, increases the temperature of the amalgam deposit and the mercury vapor pressure, which leads, in turn, to a further reduction of the voltage. Also, in the reverse direction, increases in the lamp voltage thus produce a corresponding build-up effect.

Consequently, this system cannot be kept stable at the optimum operating point, as for example at a mercury vapor pressure of 0.8 Pa.

BRIEF SUMMARY OF THE INVENTION

The invention is thus based on the object of providing an operating mode for an amalgam lamp which ensures a stable operation in the region of the power optimum.

Starting from an operation of the type described at the outset, this object is achieved according to the invention, on the one hand, in that, starting from the features of the method described at the outset, a target value of the lamp current $I_{target}$ is set that is less than $I_{optimum}$, and that the heating current $I_{heating}$ is turned on or increased when the current falls below a lower limit $I_1$ for the lamp current and is turned off or reduced when an upper limit $I_2$ for the lamp current is exceeded.

To solve the stability problem described above, the invention takes advantage of the characteristic of amalgam lamps according to which, in the region of the optimum of the mercury vapor pressure in the discharge space, the lamp current increases with the mercury partial pressure—for power regulation of the amalgam lamp. The current/voltage operating point of the lamp is not tuned—as otherwise typical—to the optimum UVC emission and thus to the optimum mercury vapor pressure, but is instead moved to the region below the optimum mercury vapor pressure, that is, in the direction of a lower lamp current. Therefore, a lower mercury vapor pressure is indeed produced, but with the possibility of increasing this again using an additional control element, namely by applying a heating current or by increasing an already applied heating current. In this way it is possible to stabilize the regulation system and to prevent build-up effects.

It is important that the target value of the lamp current be shifted outside of the optimum in the direction of a reduced mercury vapor pressure and not in the opposite direction.

Thus, an opposite shifting would require a measure for the additional lowering of the mercury vapor pressure, which is not easily possible.

By applying or increasing a heating current through the heating element, the amalgam deposit is heated or is heated more, so that the mercury vapor pressure increases. In the ideal case, the operating point shifts to the optimum for the mercury vapor pressure and the UVC emission.

In this operation, changes to the lamp voltage or to the lamp current do not lead to build-up effects in the regulation system. If the lamp current falls below the specified value $I_{target}$, the heating current is turned on or increased, so that the operating point A shifts to the right again in FIG. 4. Consequently, the lamp current increases again above the value $I_{target}$, for example to the value $I_{optimum}$, which is used, in turn, as the signal for turning off the heating current by the heating element, and consequently the operating point A is shifted to the left again.

By this operation it is possible to stabilize the operating point A of the amalgam lamp in the vicinity of the optimum. Here, the displacement of the operating point A relative to the optimum can be so slight that the UVC emission is not reduced significantly.

In this respect an operation is preferred in which the difference between $I_{target}$ and $I_{optimum}$ is in the range of 0.1 to 10% of $I_{optimum}$.

A slight shifting of the operating point is sufficient, because it is merely important to be able to use the heating of the amalgam deposit as an additional control element for the regulation. A difference of more than 10% requires a frequent or continuous heating of the amalgam deposit without an additional significant contribution to the stability of the regulation system. With a difference of less than 0.1% only a slight improvement is produced with respect to the regulation stability.

According to the invention, limits $I_1$ and $I_2$ are provided for turning on or off and for increasing or decreasing the heating current, respectively. The lower limit $I_1$ can be less than $I_{target}$, and the upper limit $I_2$ can be between $I_{target}$ and $I_{optimum}$. Preferably, however, the following applies:

$$I_1=I_2=I_{target}$$

With this method of proceeding the heating current is turned on or increased when the current falls below the target value $I_{target}$ and is turned off or decreased again when $I_{target}$ is exceeded. The operation according to the invention has proven especially effective when $I_{optimum}$ is produced at a mercury vapor pressure in the range of 0.2 to 2 Pa, preferably around 0.8 Pa.

In a power regulation of the amalgam lamp the lamp voltage has a reciprocal relationship to the lamp current (=discharge current) due to the relationship P=U×I. Therefore, a shifting of the operating point for the lamp voltage $U_{target}$ to t higher values than $U_{optimum}$ leads, in principle, to the o same result as the shifting explained above for the operating point of the lamp current to lower values. This is also shown schematically in FIG. 4.

Therefore, the technical problem specified above is also solved in an equivalent way by an operation in which a target value of the lamp voltage $U_{target}$ is set that is higher than $U_{optimum}$, and that the heating current $I_{heating}$ is turned on or increased when an upper limit $U_1$ for the lamp voltage is exceeded and is turned off or reduced when the voltage falls below a lower limit $U_2$ for the lamp voltage. To solve the stability problem described above, the invention takes advantage of the characteristic of amalgam lamps according to which, in the region of the optimum of the mercury vapor pressure in the discharge space, the lamp voltage decreases with the mercury partial pressure. The current/voltage operating point of the lamp is not tuned—as otherwise typical—to the optimum UVC emission and thus to the optimum mercury vapor pressure, but instead is moved into the region below the optimum mercury vapor pressure, that is, in the direction of a higher lamp voltage. Therefore, a lower mercury vapor pressure is indeed produced, but with the possibility of increasing this again using an additional control element, namely by applying a heating current or by increasing an already applied heating current. Therefore, it is possible to stabilize the regulation system and to prevent build-up effects.

It is important that the target value of the lamp voltage is shifted outside of the optimum in the direction of a reduced mercury vapor pressure and not in the opposite direction. Thus, an opposite shifting would require a measure for the additional lowering of the mercury vapor pressure, which is not easily possible.

By applying or increasing a heating current through the heating element, the amalgam deposit is heated or is heated more, so that the mercury vapor pressure increases. In the ideal case, the operating point shifts into the optimum for the mercury vapor pressure and the UVC emission.

With this operation changes to the lamp voltage do not lead to build-up effects in the regulation system. If the lamp voltage increases over the specified value $U_{target}$, the heating current is turned on or increased, so that the operating point A in FIG. 4 shifts to the right again. Consequently, the lamp voltage decreases again below the value $U_{target}$, for example to the value $U_{optimum}$, which is used, in turn, as a signal for turning off the heating current through the heating element, and consequently the operating point A is shifted to the left again.

Through this operation it is possible to stabilize the operating point A of the amalgam lamp in the vicinity of the optimum. Here, the shifting of the operating point A relative to the optimum can be so slight that the UVC emission is not reduced significantly. In this respect an operation is preferred in which the difference between $U_{target}$ and $U_{optimum}$ is in the range of 0.1 to 10% of $U_{optimum}$.

A slight shifting of the operating point is sufficient, because it is only important to be able to use the heating of the amalgam deposit as an additional control element for the regulation. A difference of more than 10% requires a frequent or continuous heating of the amalgam deposit without an additional significant contribution to the stability of the regulation system. With a difference of less than 0.1%, only a slight improvement with respect to the regulation stability is produced.

According to the invention, thresholds $U_1$ and $U_2$ are provided for turning on or off and for increasing or decreasing the heating current, respectively. The upper limit $U_1$ can be higher than $U_{target}$ and the lower limit $U_2$ can be between $U_{target}$ and $U_{optimum}$. Preferably, however, the following applies:

$$U_1=U_2=U_{target}$$

With this method of proceeding the heating current is turned on or increased when the voltage falls below the target value $U_{target}$ and is turned off again or reduced when $U_{target}$ is exceeded.

The operation according to the invention has proven especially effective when $U_{optimum}$ is produced at a mercury vapor pressure in the range of 0.2 to 2 Pa, preferably around 0.8 Pa.

In the following, operating methods are explained that are advantageous both for the shifting of the operating point for the lamp voltage and also for the equivalent shifting of the operating point for the lamp current.

For example, the heating current $I_{heating}$ is preferably set as a function of the magnitude of a target lamp current $I_{target}$, wherein the heating current is between 20% and 70%, preferably less than 50% of the target lamp current $I_{target}$.

A low heating current of less than 20% of the target lamp current $I_{target}$ requires a long heating period before the mercury vapor pressure increases significantly and therefore leads to a slow regulation. A high heating current of greater than 70% of the target lamp current $I_{target}$, however, easily leads to overheating and excessive swings in regulation. The heating current is therefore set as small as possible and as high as necessary, especially preferred at a value less than 50% of the target lamp current.

The heating element for heating the amalgam deposit can provided by a separate heating device. With respect to a simple and compact construction of the amalgam lamp, however, it has proven especially effective if one of the electrodes has a coil-shaped construction and serves as a heating element for the amalgam deposit.

The operation according to the invention for an amalgam lamp assumes a dependency of the lamp voltage on the mercury vapor pressure. This dependency is especially pronounced in amalgam lamps having a filling gas containing neon or helium. Therefore, the operation according to the invention is advantageously notable especially in an amalgam lamp in which the discharge space contains a filling gas containing neon or helium.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
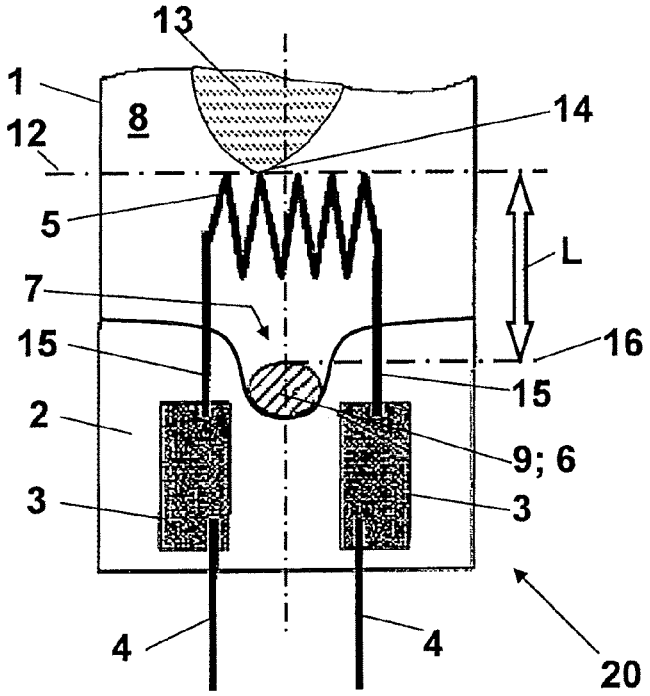
FIG. 1 is a detail of an amalgam lamp in a front view.

FIG. 1 shows schematically one of the two ends of an amalgam lamp 20, which distinguishes itself by a nominal power of 800 W (at a nominal lamp current of 8 amp), an emitter length of 150 cm and consequently by a power density of somewhat less than 5 W/cm. It comprises a quartz glass tube 1, which is sealed on its ends with crimped sections 2, in which molybdenum foils 3 and also the ends of metallic terminals 4 to a coil-shaped electrode 5 are embedded. The electrode 5 has legs 15 connected to the molybdenum foil 3.

Between the electrode 5 and a second electrode opposite it (see FIG. 2) an electric arc 13 is generated during operation, whose foot 14 ends on the surface of the electrode 5. The upper edge of the electrode, at which the nadir 14 of the electric arc 13 attaches, is marked with a dashed line 12.

The crimped section 2 on the shown end is provided with a hollow space 9, which serves as a receptacle for an amalgam deposit 6. The hollow space 9 has an opening 7 to the discharge space 8. The opening width of the opening 7 is significantly narrower than the maximum open width of the hollow space 9 and also narrower than the maximum diameter of the amalgam deposit 6, so that the amalgam is trapped in the hollow space 9 and cannot penetrate into the discharge space 8 in solid form. In the embodiment the maximum opening width of the opening 7 is 2 mm.

Therefore, the amalgam deposit 6 is fixed in the vicinity of the electrode 5. The electrode 5 is heated by the electric arc 13 to a temperature that depends on the current power of the amalgam lamp 20 and which operates on the amalgam deposit 6 as a function of distance. The distance is measured between the upper edge 12 of the electrode coil and the upper edge 16 of the amalgam deposit; in the embodiment it is approximately 4.5 cm.

Figure 2:
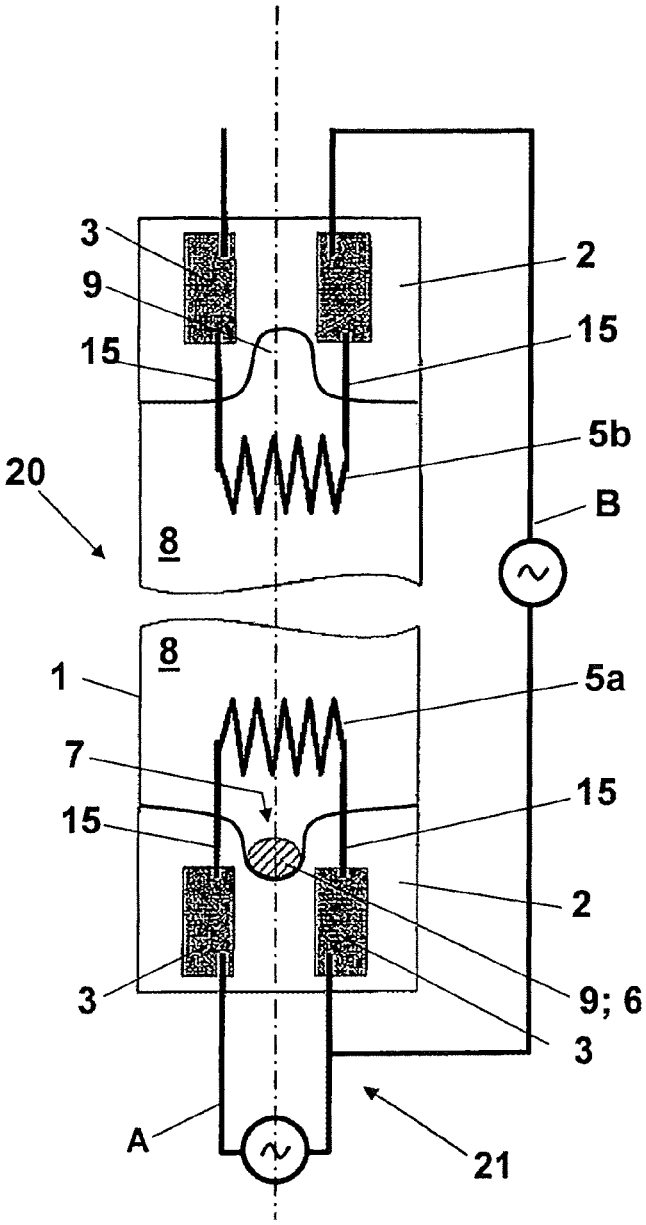
FIG. 2 is a circuit diagram showing a part of the power supply of the amalgam lamp.

From FIG. 2 it becomes clear that within the discharge space 8 (shown broken) of the amalgam lamp 20, the coil-shaped electrodes 5*a*, 5*b* lie opposite each other. An amalgam deposit is provided only in the hollow space 9 that lies adjacent to the coil-shaped electrode 5*a*.

The power supply of the amalgam lamp 20 comprises two independent circuits A and B. The circuit A serves for heating the electrode 5*a* and thereby for the additional heating of the amalgam deposit. The second circuit B serves for applying the nominal lamp current of 7 amp. The circuits A and B are part of a ballast and a regulation device 21.

Figure 3:
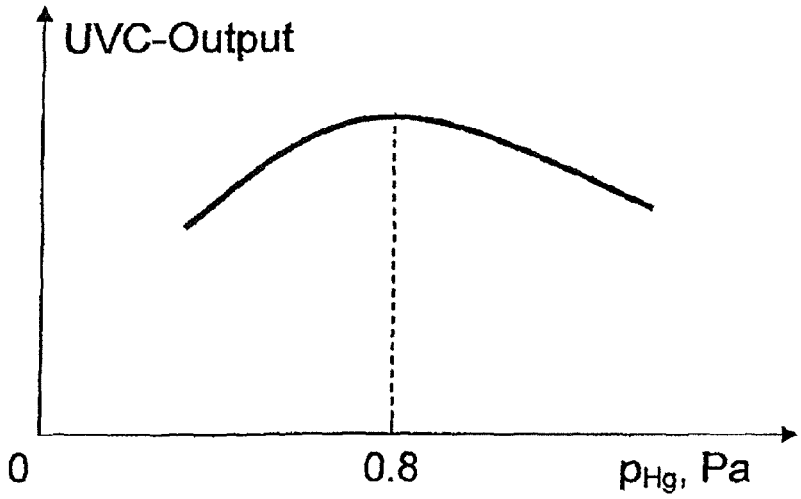
FIG. 3 is a diagram of the dependency of the UVC emission on the mercury vapor pressure.

The discharge space 8 of the amalgam lamp 20 contains, in addition to mercury, a noble gas, namely neon. The amalgam lamp 20 exhibits a maximum UVC emission at a mercury vapor pressure around 0.8 Pa, as shown schematically in the diagram of FIG. 3, in which the UVC emission is recorded in relative units versus the mercury vapor pressure in [Pa].

Figure 4:
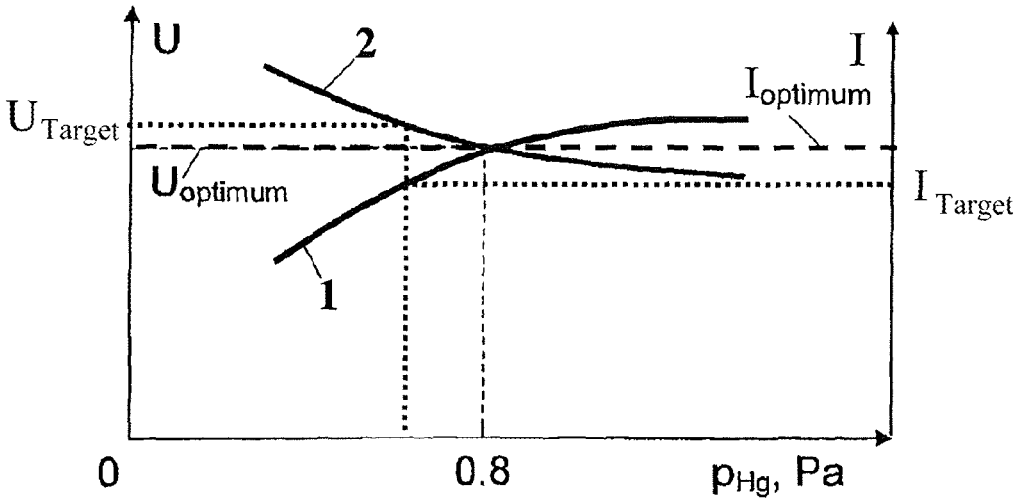
FIG. 4 is a diagram of the dependency of the lamp voltage and the discharge current (lamp current) on the mercury vapor pressure in the case of a power regulation of the amalgam lamp.

As already explained above, in such amalgam lamps the lamp voltage and the lamp current depend on the mercury vapor pressure in the case of power regulation, as shown schematically in the diagram of FIG. 4. On the left ordinate is the lamp voltage U and on the right ordinate is the lamp current I, each in relative units, versus the mercury partial pressure $p_{Hg}$ in [Pa]. The optimum operating voltage $U_{optimum}$ and the optimum operating current $I_{optimum}$ produce a mercury vapor pressure around 0.8 Pa.

In the following, the method according to the invention for operating the amalgam lamp 20 will be explained in more detail with reference to examples and FIGS. 1 to 4:

EXAMPLE 1

The amalgam lamp 20 at a nominal power of 800 W is operated by a power-regulated ballast in the "constant power" operating mode.

The nominal operating current in the circuit B is reduced from 7.2 amp to a value $I_{target}$ 7.0 amp and the nominal voltage is increased accordingly. The temperature of the electrode 5*a* thereby decreases and consequently also the temperature of the amalgam deposit 6, so that the mercury concentration in the discharge space 8 decreases, and therefore the efficiency of the UVC emission decreases slightly.

In contrast however, a more stable operation of the amalgam lamp 20 is produced. This is achieved in that an additional control element is provided for the regulation, that is, in the form of the heating current $I_{heating}$, which can be conducted through the coil-shaped electrode 5*a* via the circuit A. This causes a temperature increase of the electrode 5*a* and thus accordingly an additional heating of the amalgam deposit 6 arranged in the vicinity of the electrode 5*a*.

The heating current $I_{heating}$ is turned on as soon as the current falls below the target value for the operating current of 7.0 amp, and it is turned off as soon as the operating current reaches 7 amp. The heating current equals 30% of the target lamp current $I_{target}$, that is approximately 2.0 amp.

EXAMPLE 2

In an equivalent operation mode, instead of the operating current, the operating voltage is adjusted. Here also, the amalgam lamp 20 is operated at a nominal power of 800 W by a power-regulated ballast in the "constant power" operating mode.

The nominal operating voltage of 112 V is increased to a value $U_{target}$ 115 V, and the nominal current $I_{target}$ in the current circuit B is reduced accordingly. Therefore, the temperature of the electrode 5*a* decreases and consequently also the temperature of the amalgam deposit 6, so that the mercury concentration in the discharge space 8 decreases, and the efficiency of the UVC emission thereby decreases slightly.

In contrast however, a more stable operation of the amalgam lamp 20 is produced. This is achieved in that an additional control element is provided for the regulation, that is, in the form of the heating current $I_{heating}$, which can be conducted through the coil-shaped electrode 5*a* via the circuit A. This causes a temperature increase of the electrode 5*a* and thus accordingly an additional heating of the amalgam deposit 6 arranged in the vicinity of the electrode 5*a*.

The heating current $I_{heating}$ is turned on as soon as the target value for the operating voltage of 115 V is exceeded, and it is turned off as soon as the operating voltage reaches 115 V again. The heating current is 30% of the target lamp current $I_{target}$, that is approximately 2.0 amp It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A method for operating an amalgam lamp having a nominal power Pnominal, the lamp comprising a discharge space containing a filling gas, wherein the discharge space is accessible for an amalgam deposit, which is heatable by a heating element in which a heating current ($I_{heating}$) is conducted through the heating element, the method comprising applying a lamp voltage $U_{optimum}$ designed for a maximum UVC emission between electrodes or flowing a lamp current $I_{optimum}$ designed for a maximum UVC emission between electrodes, setting a target value of a lamp current $I_{target}$ that is less than $I_{optimum}$, turning on or increasing the heating current ($I_{heating}$) when the lamp current falls below a lower limit $I_1$, and turning off or reducing the heating current ($I_{heating}$) when an upper limit $I_2$ for the lamp current is exceeded.

2. The method according to claim 1, wherein a difference between $I_{target}$ and $I_{optimum}$ is in the range of 0.1 to 10% of $I_{optimum}$.

3. The method according to claim 1, wherein: $I_1=I_2=I_{target}$.

4. The method according to claim 1, wherein $I_{optimum}$ is produced for a mercury vapor pressure in a range of 0.2 to 2 Pa.

5. The method according to claim 1, wherein the heating current ($I_{heating}$) is set as a function of magnitude of a target lamp current $I_{target}$, and wherein the heating current ($I_{heating}$) is between 20% and 70% of the target lamp current $I_{target}$.

6. The method according to claim 5, wherein the heating current ($I_{heating}$) is less than 50% of the target lamp current $I_{target}$.

7. The method according to claim 1, wherein one of the electrodes has a coil-shaped construction and serves as a heating element for the amalgam deposit.

8. The method according to claim 1, wherein the filling gas contains neon or helium.

9. A method for operating an amalgam lamp having a nominal power $P_{nominal}$, the lamp comprising a discharge space containing a filling gas, wherein the discharge space is accessible for an amalgam deposit, which is heatable by a heating element in which a heating current ($I_{heating}$) is conducted through the heating element, the method comprising applying a lamp voltage $U_{optimum}$ designed for a maximum UVC emission between electrodes or flowing a lamp current $I_{optimum}$ designed for a maximum UVC emission between electrodes, setting a target value of a lamp voltage $U_{target}$ that is higher than $U_{optimum}$, turning on or increasing the heating current ($I_{heating}$) when an upper limit $U_1$ for the lamp voltage is exceeded, and turning off or reducing the heating current ($I_{heating}$) when the voltage falls below a lower limit $U_2$ for the lamp voltage.

10. The method according to claim 9, wherein a difference between $U_{target}$ and $U_{optimum}$ is in a range of 0.1 to 10% of $U_{optimum}$.

11. The method according to claim 9, wherein: $U_1=U_2=U_{target}$.

12. The method according to claim 9, wherein $U_{optimum}$ is produced for a mercury vapor pressure in the range of 0.2 to 2 Pa.

13. The method according to claim 9, wherein the heating current ($I_{heating}$) is set as a function of magnitude of a target lamp current $I_{target}$, and wherein the heating current ($I_{heating}$) is between 20% and 70% of the target lamp current $I_{target}$.

14. The method according to claim 13, wherein the heating current ($I_{heating}$) is less than 50% of the target lamp current $I_{target}$.

15. The method according to claim 9, wherein one of the electrodes has a coil-shaped construction and serves as a heating element for the amalgam deposit.

16. The method according to claim 9, wherein the filling gas contains neon or helium.

* * * * *